US005429442A

United States Patent [19]

Schrader

[11] Patent Number: 5,429,442

[45] Date of Patent: Jul. 4, 1995

[54] PRINT HAMMER COIL CURRENT CONTROL

[75] Inventor: Robert E. Schrader, Johnson City, N.Y.

[73] Assignee: International Business Machines Corp., Armonk, N.Y.

[21] Appl. No.: 319,369

[22] Filed: Oct. 6, 1994

Related U.S. Application Data

[63] Continuation of Ser. No. 848,453, Mar. 5, 1992, abandoned.

[51] Int. Cl.[6] ..... B41J 9/38

[52] U.S. Cl. ..... 400/157.3; 400/166

[58] Field of Search ..... 400/157.2, 157.3, 166; 361/152, 153, 154

[56] References Cited

U.S. PATENT DOCUMENTS

| | | | |
|---|---|---|---|
| 4,048,665 | 9/1977 | Lia et al. | 361/152 |
| 4,254,705 | 3/1981 | Ishikawa | 400/157.2 |
| 4,348,119 | 9/1982 | Carson | 400/157.2 |
| 4,381,532 | 4/1983 | Arnold | 361/154 |
| 4,485,425 | 11/1984 | Gruner | 400/157.2 |
| 4,503,480 | 3/1985 | Pickard et al. | 361/152 |
| 4,531,300 | 7/1985 | Heidel et al. | 33/366 |
| 4,556,926 | 12/1985 | Yanagida | 361/154 |
| 4,680,667 | 7/1987 | Petrie | 361/154 |
| 4,953,056 | 8/1990 | Yakawa et al. | 361/154 |
| 4,984,248 | 1/1991 | Hong | 375/7 |
| 5,032,031 | 7/1991 | Gruner | 400/157.2 |
| 5,223,806 | 6/1993 | Curtis et al. | 333/12 |
| 5,251,091 | 10/1993 | Ito et al. | 361/152 |

OTHER PUBLICATIONS

I.B.M. Technical Disclosure Bulletin vol. 23 No. 9 Feb. 1981 pp. 4107–4109.

"Compact Current to Voltage Received with High Input Noise Immunity", Research Disclosure, N326, Jun. 1991, 32641.

IBM TDB, vol. 30, No. 6, Nov. 1987, "Print Hammer Drive Circuit", G. Melnyk et al., pp. 247–248.

*Primary Examiner*—David A. Wiecking
*Assistant Examiner*—Steven S. Kelley
*Attorney, Agent, or Firm*—Michael E. Belk

[57] ABSTRACT

A low cost, integrated circuit compatible, circuit for constantly controlling the current in a print hammer coil is provided. The circuit is suitable for use with a hammer coil driven from the low voltage side (bottom drive) and in series with a sense resistor. A programmable reference that actively compensates the coil current for drift in the hammer coil bias power supply reference generating means is included to allow accurate detection of coil current levels. The control circuit reduces generated noise and has good noise immunity.

2 Claims, 5 Drawing Sheets

TO OTHER DRIVER CIRCUITS
TO OP AMP 77
75
73
(VBUS)
67
CURRENT MIRROR
IREF
69
71
55
P
(Z)
63
N
65
53
P
V2
(Y)
57
61
51
33
47
(X)
37
45
39
V1
32
(VERROR)
34
35
43
(VREF)
V2
REF
41

PRINT HAMMER COIL CURRENT CONTROL

The application is a continuation of application Ser. No. 07/848,453, filed Mar. 5, 1992, now abandoned.

BACKGROUND OF THE INVENTION

The present invention relates generally to monitoring and controlling the current in inductor coils in the form of electromagnet coils, solenoids, or electric motor windings, and more particularly to controlling print hammer coil current.

An example of an electromagnet coil application is impact printing. In an impact printer there are many character positions per line on a printed page. A separate electromagnetic coil is used to move a print hammer for each print position. To print a desired character in a given print position, the electromagnetic coil for that print position is actuated with a current pulse at the proper time relationship with the desired character's position on a rotating metal character band. The speed of the rotating character band can be over 200 inches per second. The actuating current pulse causes the physical movement of the print hammer which quickly pushes the paper into a moving ink ribbon and both against only the desired character on rotating character band. The tolerance on the actuating current pulse is very important to print quality because the flight time of the print hammer is indirectly proportional to the energy in that current pulse. The contact time between the paper and moving ribbon and character band must be very small to avoid a print smudge or paper tear.

For impact printer applications that require accurate actuating current pulse control, a current chopping technique is used typically with two methods of controlling and sensing the current in an electromagnetic print hammer coil.

The 'Top Drive' method has a control switch (PNP transistor or PFET) connected to the positive bias power supply. The coil is connected in between the switch and a sense resistor which is connected to the power ground node. With this method, the voltage across the sense resistor is directly proportional to the current flowing in the coil. There are two main problems with the 'Top Drive' control method. Since the control switch is connected to the positive bias power supply, high voltage, high power pre-drive components are needed to control the switch device. The second problem is that the voltage sensed on the sense resistor requires that the power ground node be part of the sense circuitry. The power ground node is electrically very noisy.

The 'Bottom Drive' method has the coil connected to the positive bias power supply. The control switch (NPN transistor or NFET) is connected between the coil and a sense resistor which is connected to the power ground node. With this method, the voltage across the sense resistor is proportional to the current flowing in the coil only during the time that the switch device is 'ON'. This is the main problem with this control method, during the 'Off' chopping cycle (control switch off) there is no way of monitoring the current flowing in the coil. A 'Fixed Off Time' is usually used, but the average current level cannot be set as accurately with this method because of the non-linearity of the coil's inductance. The power ground node must be part of the sensing circuitry with this control method also.

The electrical environment of a magnetic assembly is usually very noisy. The noise is mainly a result of the following circuit functions. The switching of large currents through the inductance of the power supply cables. The low impedance of the magnetic coil's clamp diode during reverse recovery. The actuating and chopping of many magnetic coils at the same time. The physical compactness of the package layout allows noise coupling between components. Despite the noisy environment of the assembly, very accurate current level sensing and control must be preformed.

It is an object of the present invention to provide a print hammer coil current control that is low cost and integrated circuit compatible.

It is another object of the present invention to provide a print hammer coil current control that constantly monitors the current in the print hammer coil.

It is still another object of the present invention to provide a print hammer coil current that reduces noise supplied to other circuits and has improved noise immunity.

SUMMARY OF THE INVENTION

In one aspect of the present invention, a circuit for monitoring the current flowing in an inductor is provided. A first resistor is connected in series with the inductor and a current source is connected in parallel with the first resistor. The current source provides a current proportional to the voltage across the sense resistor which in turn is proportional to the current in the inductor.

In another aspect of the present invention, a circuit for monitoring the current in a print hammer coil supplied from a first voltage source is provided, with the hammer coil switched from the low voltage side. The circuit includes a first resistor in series with the print hammer coil and a diode in parallel with the series combination of the first resistor and the inductor. The diode is connected to carry current from the coil, when the current supplied to the coil is interrupted. A current source is connected in parallel with the first resistor and provides a current proportional to the voltage across the first resistor, so that the current in the coil is constantly monitored.

DETAILED DESCRIPTION OF THE INVENTION

Figures 1, 1A, 1B:
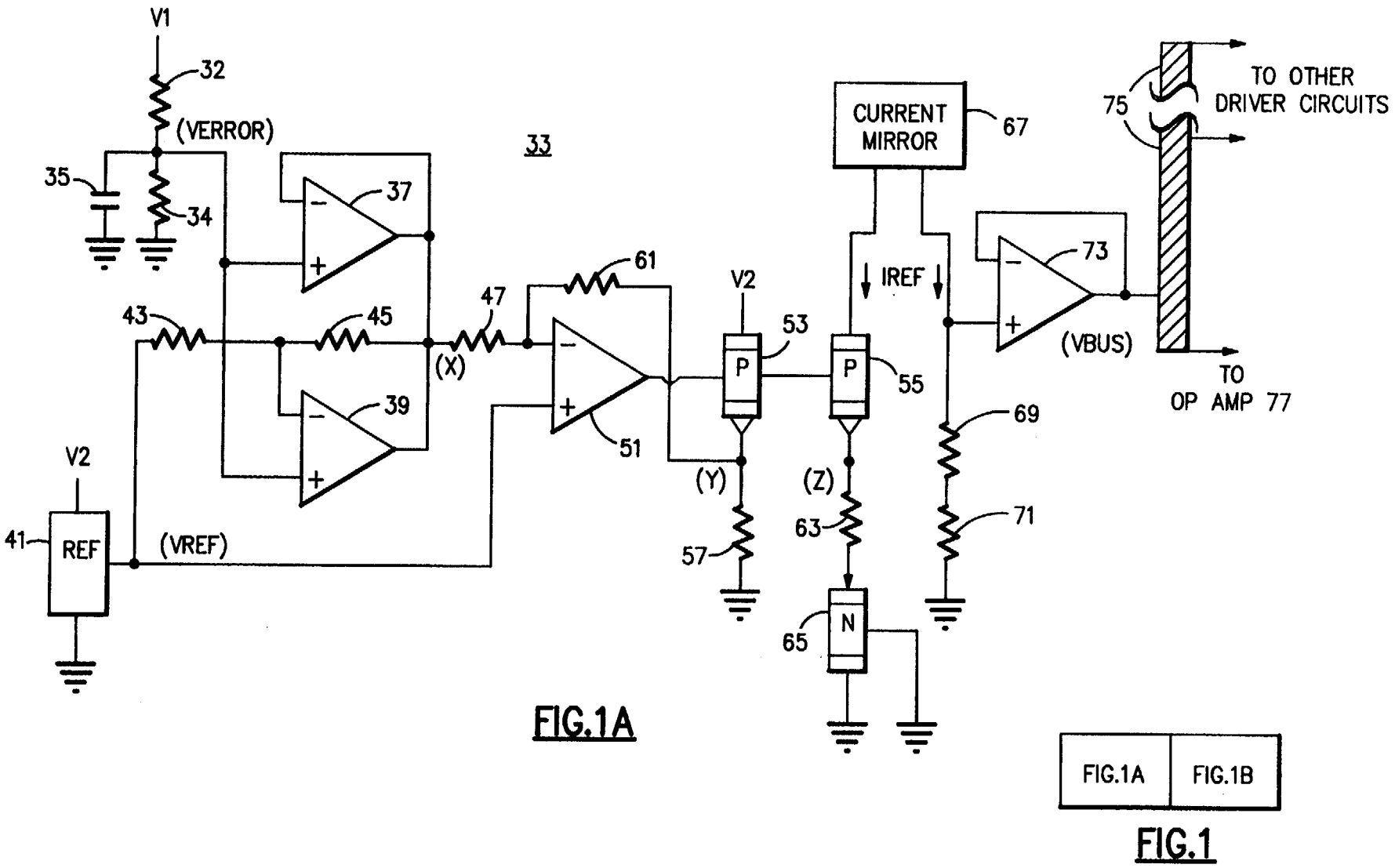
FIG. 1 is a part schematic, part block diagram representation of a print hammer coil current control in accordance with the present invention.
Figure 1B:
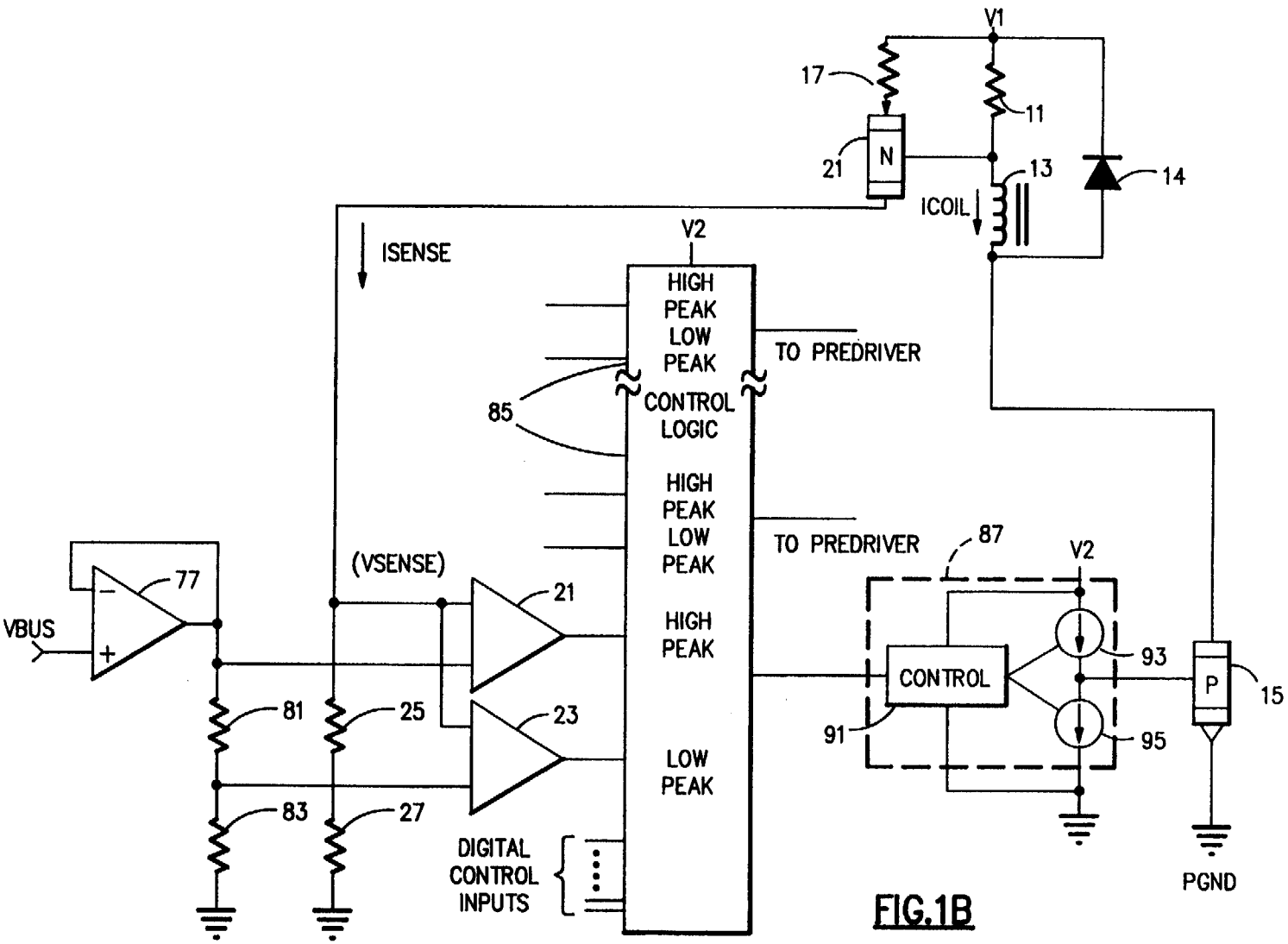

Referring now to the drawing, wherein like elements are indicated by like reference numerals throughout, and particularly FIG. 1 thereof where, a print hammer coil current control is shown. A voltage supply V1 for providing power to operate a print hammer is connected in series with a sense resistor 11, a print hammer coil 13, a switch 15, which in the present embodiment comprises an npn transistor, and to a power ground labelled PGND. A clamp diode 14 is connected in parallel with the series combination of the coil 13 and sense resistor 11, with anode of the diode connected to the coil and the cathode of the diode connected to the sense resistor. A current ICOIL flows through the coil 13. A current source comprising a resistor 17 in series with a pnp transistor 21, generates the current ISENSE. The emitter of transistor 21 is connected through resistor 17 to the end of the sense resistor 11 that is connected to the voltage V1. The base of transistor 21 is connected to the other end of sense resistor 11. The collector of transistor 21 is connected to one input of each of two comparators 21 and 23, and the collector is also connected through two series connected resistors 25 and 27 to a logic ground. The voltage VSENSE is developed across resistors 25 and 27. To improve noise immunity, the circuit shown in FIG. 2 can be substituted for resistors 25 and 27 to generate the voltage VSENSE.

Figure 2:
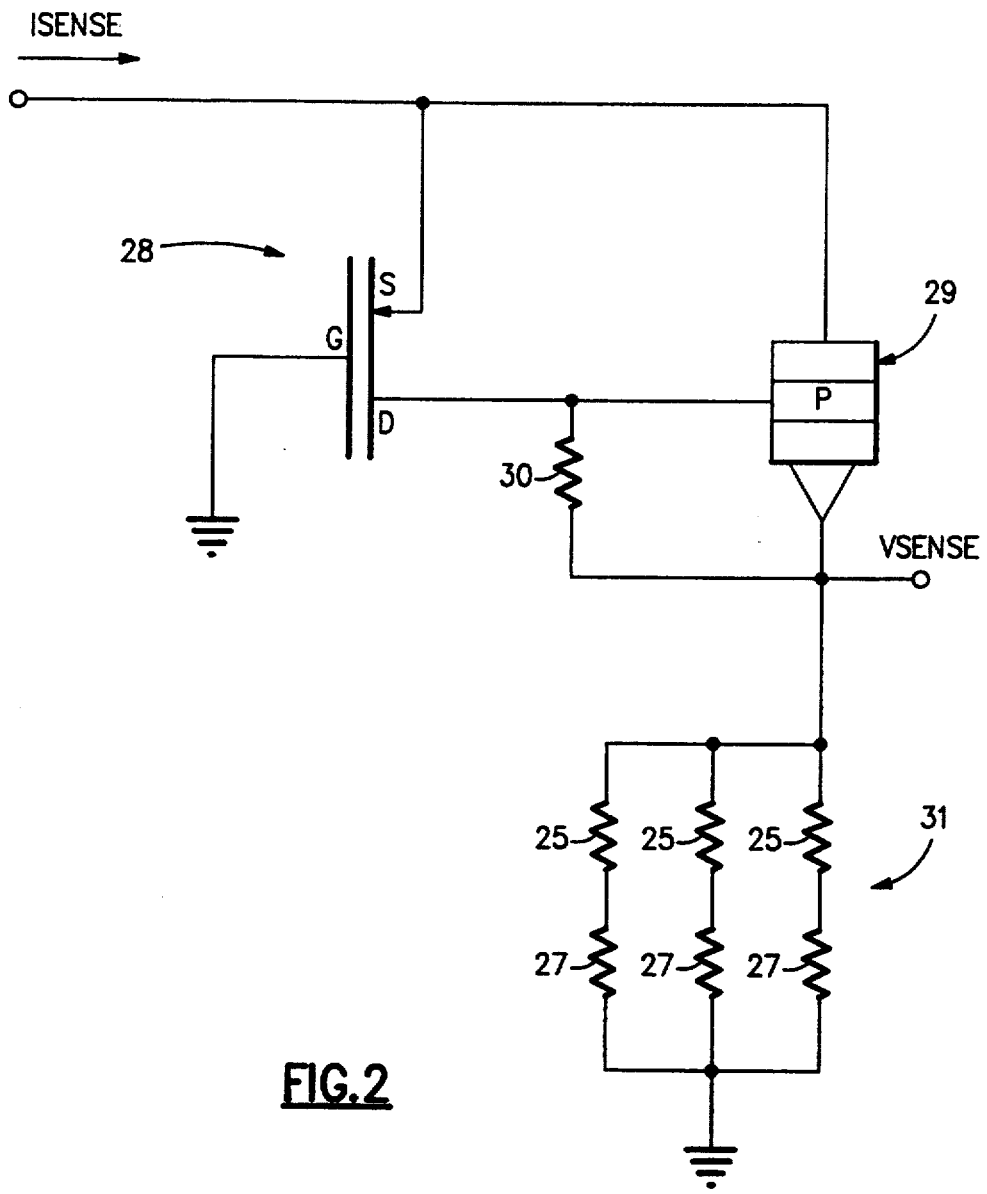
FIG. 2 is a schematic diagram of equivalent circuitry for the series resistors 25 and 27 of FIG. 1, to generate an output voltage responsive to an input current with high input noise immunity.

FIG. 2 shows a compact current to voltage receiver with high input noise immunity. The current ISENSE is supplied to the source of a p-channel FET 28 and to the collector of a npn transistor 29. The gate of transistor 28 is connected to logic ground. The drain of transistor 28 is connected to the base of transistor 29. A bias resistor 30 connects the base of transistor 29 to its emitter. The emitter of transistor 29 is connected to logic ground through a resistance 31. Resistance 31 in the preferred embodiment comprises three parallel connected pairs of resistors 25 and 27. The circuit accurately converts the input current ISENSE to an output voltage VSENSE available at the emitter of transistor 29, as a function of the value of resistance 31. The circuit input noise immunity at the source of transistor 28 when the input current level is zero is greater than two volts. When the input current ISENSE is applied, the circuit impedance is less than 80% of the value of resistance 31. When ISENSE is zero, the source to gate voltage of transistor 28 will be near zero and no drain current will flow. With no bias current in resistor 30, transistor 29 is biased off and the circuit output voltage will be near zero. When ISENSE is not zero, the source to gate voltage of transistor 28 will become sufficiently positive so that the drain current will equal the sum of the current bias in resistor 30 and the base drive flowing to transistor 29. Transistor 29 will conduct the majority of the current ISENSE to the VSENSE node. The output voltage VSENSE is a function of the input current ISENSE and the resistance 31.

Referring again to FIG. 1, the voltage V1 is also supplied to a piecewise linear reference compensation circuit 33 which includes a programmable reference that actively compensates the coil current for drift in the hammer coil bias power supply. A voltage divider, including two resistors 32 and 34 connected to logic ground, is supplied by the voltage V1. The compensation circuit further includes a capacitor 35 connected in parallel with resistor 34. The junction of the two resistors 32 and 34 is connected to the noninverting inputs of each of two operational amplifiers 37 and 39. A voltage reference 41 provides a voltage VREF through a resistor 43 to the inverting input of operational amplifier 39. The inverting input of operational amplifier 37 is connected to the output of the operational amplifier 37. A feedback resistor 45 is connected between the inverting input of operational amplifier 39 and the output of operational amplifier 39. The outputs of operational amplifier 37 and 39 are connected to one another and connected through a resistor 47 to the inverting terminal of an operational amplifier 51. The reference voltage from reference 41 is connected to the noninverting input of operational amplifier 51. The output of operational amplifier 51 is connected to the bases of npn transistors 53 and 55. The collector of transistor 53 is connected to a voltage V2 for supplying the logic and control circuitry. The emitter of transistor 53 is connected through a resistor 57 to logic ground. A feedback resistor 61 is connected between the junction of the emitter of transistor 53 and resistor 57, and the inverting input of operational amplifier 51. The emitter of transistor 55 is connected through a resistor 63 to the emitter of a pnp transistor 65. The base and collector of transistor 65 are connected to the logic ground. A current mirror 67 directs the current set by the collector of transistor 55 through the series connected resistors 69 and 71 to logic ground. The ungrounded end of the series connected resistors 69 and 71 is connected to the output of current mirror 67, and is also connected to the noninverting input of an operational amplifier 73. The output of operational amplifier 73 is connected to a reference bus 75 which provides a bus voltage VBUS.

In a preferred embodiment of reference compensation circuit 33, all components except for reference 41, capacitor 35, resistors 32, 34, 43, 45, 47, 61 and 63, and transistor 65 are provided on an integrated circuit. The discrete components that are not integrated provide for customization.

The reference bus 75 provides a reference voltage to each of the driver circuits connected to a respective hammer coil. Only one driver circuit and one hammer coil are shown in FIG. 1. The output of operational amplifier 77 is connected to its own inverting input and through two series connected resistors 81 and 83 to logic ground. The output of operational amplifier 77 is also connected to one of the inputs of comparator 21. The junction of resistors 81 and 83 is connected to one of the inputs of comparator 23. The outputs of comparators 21 and 23 are connected to a control logic circuit 85. The control logic circuit receives comparator inputs associated with each of the printer hammer coils with the comparator inputs of only one printer hammer coil shown connected to the control logic circuit in FIG. 1. The control logic circuit also receives digital control inputs which control which hammer coil is to be energized and the duration of the energization. The control logic provides an output to each of the predrivers, with one predriver associated with each hammer coil. One predriver 87 is shown in FIG. 1. The predriver comprises a control 91 responsive to the logic level of the output of the control logic 85 which causes one or the other of two series connected current sources 93 or 95 to operate, thereby sourcing or sinking current to or from the base of transistor 15, which in turn controls the current in the print hammer coil 13.

Figure 3:
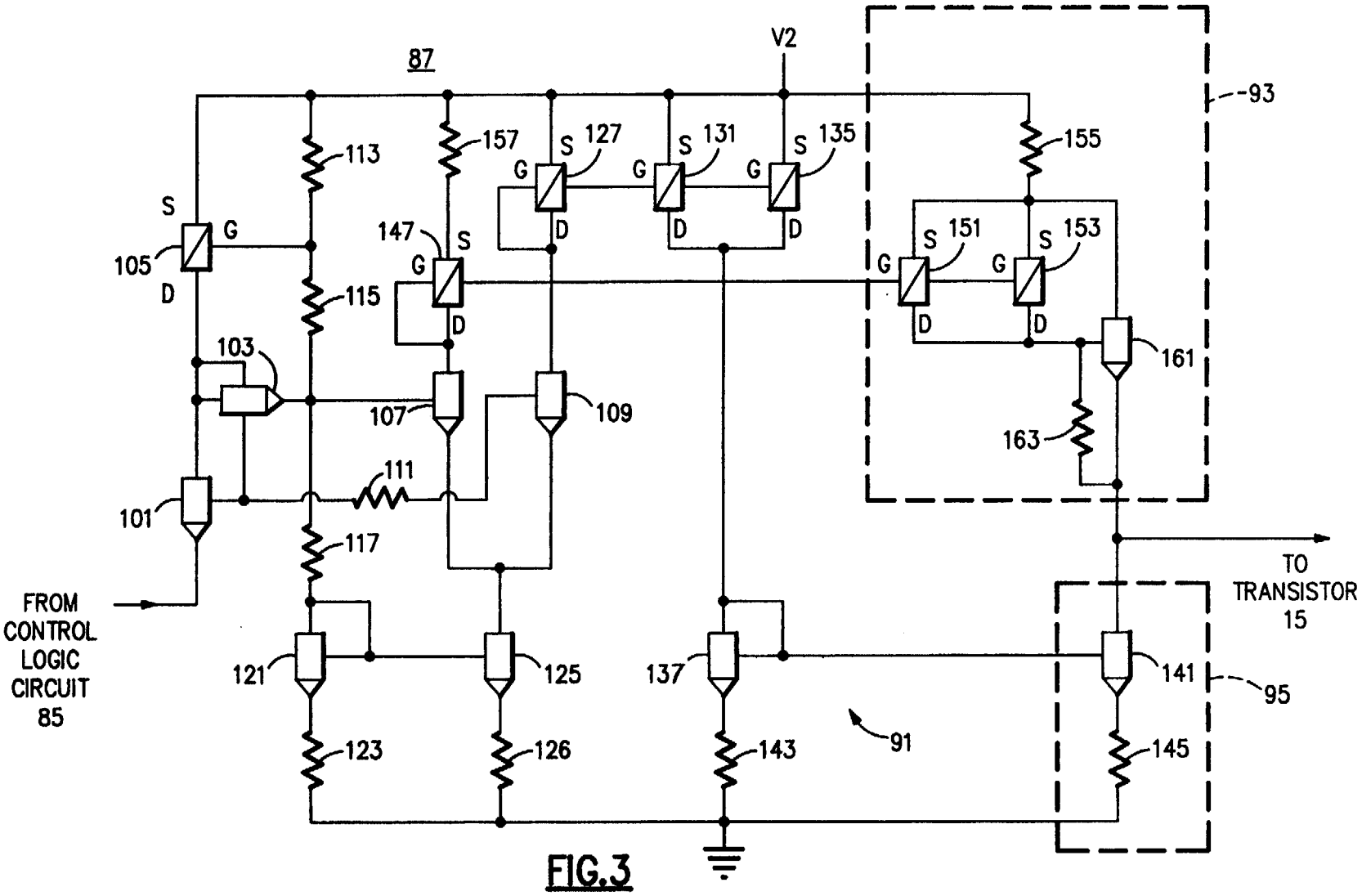
FIG. 3 is a schematic circuit diagram of the predriver of FIG. 1.

Referring now to FIG. 3 where the predriver control 87 is shown in more detail, the output of control logic circuit 85 is connected to the emitter of an npn transistor 101. Transistors 101 and 103 are connected together as diodes. The collectors and bases of npn transistors 101 and 103 are connected together and to the drain of P-channel FET 105 and to resistor 111. Transistors 107 and 109, both npn transistors, are connected as a differential pair. The emitters of transistors 107 and 109 are connected together. Voltage references are made by the connection of resistors 113, 115, 117 and 123 and npn transistor 121. Resistor 113 is connected to voltage V2 and resistor 117 is connected to the collector and base of transistor 121. The emitter of transistor 121 is connected through 123 to logic ground. The junction of resistors 113 and 115 is connected to the gate of transistor 105. The source of transistor 105 is connected to voltage V2. The emitter of transistor 103 and the base of transistor 107 are connected to the junction of resistors 115 and 117. The base of transistor 109 is connected to resistor 111. The base of transistor 121 is connected to the base of npn transistor 125. The emitter of transistor 125 is connected through resistor 126 to the logic ground. The collector of transistor 125 is connected the emitters of transistors 107 and 109. The collector of transistor 109 is connected to the drain and gate of p-channel FET 127 and the gates of p-channel FETs 131 and 135. The sources of transistors 127, 131, and 135 are connected to voltage V2. The drains of transistors 131 and 135 are connected to the collector and base of npn transistor 137 and the base of transistor 141. The emitter of transistor 137 is connected through resistor 143 to logic ground. The emitter of transistor 141 is connected through resistor 145 to logic ground. The collector of transistor 107 is connected to the drain and to the gate of p-channel FET 147 and to the gates of p-channel FETs 151 and 153. The sources of transistors 151 and 153 are connected to one another and through a resistor 155 to voltage V2. The source of transistor 147 is connected through a resistor 157 to voltage V2. The drains of transistors 151 and 153 are connected to one another and to the base of npn transistor 161. The sources of transistors 151 and 153 are connected to the collector of transistor 161. A resistor 163 connects the base of transistor 161 to its emitter. The junction of the emitter of transistor 161 and the collector of transistor 141 provide the output of the predriver. The predriven circuit 87, together with operational amplifier 77, resistors 81, 83, 25, and 27, comparators 21 and 23, and the control logic are preferably provided on an integrated circuit which includes the control threshold circuits and predrivers for the other print hammer coils.

Figure 4:
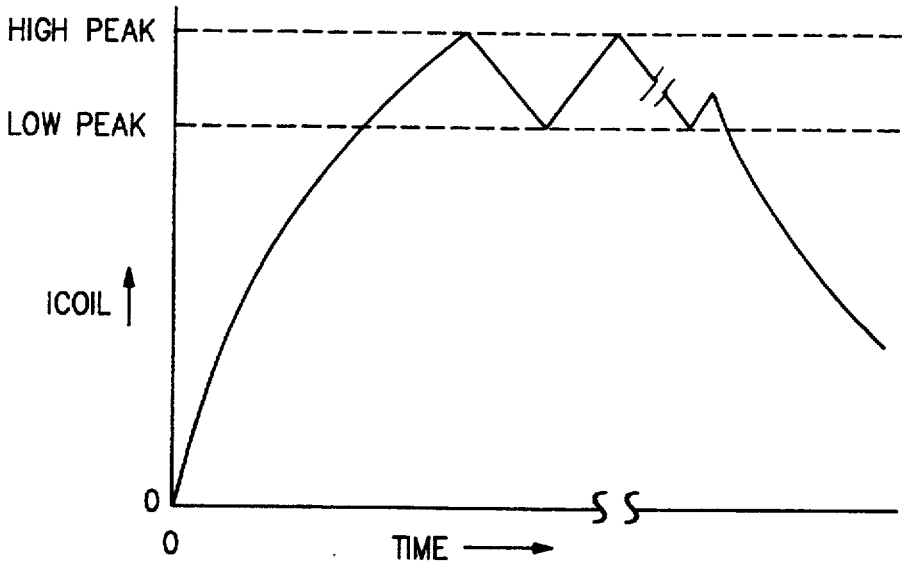
FIG. 4 is a waveform diagram of the chopped hammer coil current.

In operation, the current through the print hammer coil 13 is controlled by chopping the coil current to keep it between a high peak and a low peak reference voltage. The diode 14 in parallel with the coil 13 and the sense resistor 11 is selected to have a fast recovery time and the npn transistor 15 is selected to have a slow turn on time. This combination reduces the noise caused by the fast and large current transients that occur in the power supply V1 when the transistor 15 turns on during chopping. A typical coil current waveform is shown in FIG. 4. Energizing the print hammer coil controls print hammer motion. The pulse duration is set by printer timing which is one of the digital control inputs to the control logic circuit. The average pulse amplitude is controlled by "chopping" the coil current between a high peak and a low peak reference. These peak references are provided by comparators 21 and 23. Comparators are designed with output switching delays to filter noise on the ISENSE feedback line. The comparators 21 and 23 require a signal to be present more than the delay time (400 nanoseconds, for example) before the comparators will switch.

Figure 5:
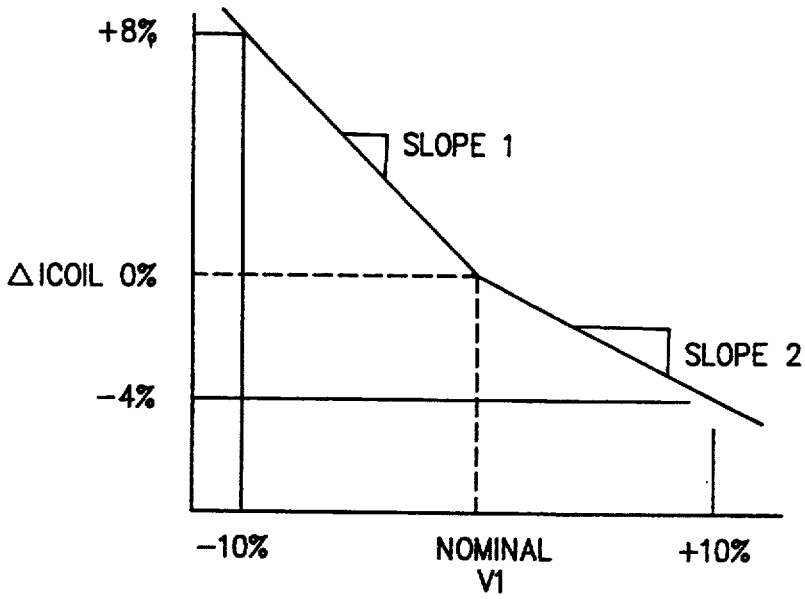
FIG. 5 is a waveform diagram of the coil current compensation as a function of the supply voltage V1.

To maintain a constant hammer flight time (constant current pulse energy) using a fixed current pulse width, the amplitude of the current pulse must be compensated for changes in the voltage of the hammer coil bias power supply V1. This is necessary since the time required for the coil current to first reach its chopping levels is a function of the bias supply voltage. The pulse amplitude adjustment is inversely proportional to the direction of change in the bias supply voltage. A typical hammer coil current compensation curve is shown in FIG. 5. The compensation rates (slopes 1 and 2) are programmable and are dependent on the type of hammer unit used and the nominal value of the hammer bias power supply voltage V1. The adjustment rate requirement for a negative change from the nominal value of the input voltage (slope 1) can be equal or greater than the adjustment rate for a positive change from the nominal value of the input voltage (slope 2).

Resistors 32 and 34 in the voltage divider of the reference/compensation circuit 33 are selected so that when the voltage V1 is nominal, node X at the output of operational amplifiers 37 and 39 will equal the reference voltage VREF provided by voltage reference circuit 41. Voltage V1 is used in the reference compensation circuit 33 only to provide an input signal and not to power any of the devices. Capacitor 35 removes any noise from the input signal. The forward gain of operational amplifier 37 is equal to 1. The forward gain of operational amplifier 39 is equal to one plus the ratio of resistor 45 divided by resistor 43. Operational amplifiers 37 and 39 are designed with limited positive output drive current. Thus, for a given value of voltage V1, the amplifier trying to set the lower output voltage at node X will be linear and set the voltage gain. The other amplifier will be nonlinear, internally saturated, and will not effect the gain. The voltage gain will have one of two values depending on the value of V1 compared to its nominal value. With all circuit parameters nominal, and the value of resistors 47 and 61 about equal, node voltages VREF, VERROR, X, Y and Z will be equal, plus or minus operational amplifier offset voltages. Current IREF is a function of node voltage Y. Change in reference voltage at node Y as a function of the voltage source V1 is as follows.

$$Y/V\text{ERROR} = (-R61/R47) \quad \text{for } V1 > \text{nominal}$$

$$Y/V\text{ERROR} = (-R61/R47)\,(1 + (R45/R43)) \quad \text{for } V1 < \text{nominal}$$

where R61, for example, refers to resistor 61.

Depending on the voltage value of node VERROR in relation to node VREF, one of two different gains functions will control node Y and node Z. The adjustment rates (slopes 1 and 2) of node Z as a function of voltage VERROR are controlled by the value of programming resistors 43, 45, 47, and 61.

Operational amplifier 51 controls the current provided to the base of transistor 53 to achieve the desired voltage at node Y which will also control the voltage at node Z. The reference/compensation circuit 33 develops a reference current IREF which is converted into the voltage VBUS by resistors 69 and 71. The current IREF is set by the voltage on the emitter of transistors 55 and 65, and the value of resistor 63. IREF is compensated for drift in supply voltage V1 by adjusting the emitter voltage of transistor 55 (node Z voltage) by adjusting its base voltage. To obtain some tracking between IREF and ISENSE, and VBUS and VSENSE, transistors 65 and 21, and resistors 17 and 63 should be the same type. Resistance 31 comprising resistors 25 and 27, 69 and 71, and 81 and 83 should be the same type and value.

The reference compensation circuit allows a single integrated design to be used with different hammer units and hammer coil bias supplies. The compensation slopes of ICOIL with respect to the nominal hammer coil bias power supply voltage are continuously controlled by a single set of operational amplifiers and programming resistors. The circuit is low noise, low power consumption, and operates from a logic power supply. The compensated reference current IREF can be used with multiple driver circuits.

There is a large amount of noise generated in the driver section of the hammer control. The noise is mainly caused by the switching of large currents (several hammers "ON") through the resistance and inductance of power cables that supply the V1 and PGND voltages. Decoupling capacitors (not shown) are used. The di/dt of the current can be high, during "chopping", at the times when the clamp diode (D1) turns "OFF". The AC and DC voltage shift (noise) on voltages V1 and PGND, when measured from logic ground, can be larger than one volt.

The coil drive switching device 15 is controlled directly by low voltage control circuit 87. To energize the print hammer, transistor 15 is biased into conduction and will saturate. The coil current ICOIL will flow from the V1 supply, through the series connection of sense resistor 11, hammer coil 13, switching transistor 15, and into the power ground. Because of the hammer coil inductance, the positive and negative changes in the amplitude of coil current ICOIL will have an L/R time constant, see the coil current waveform shown in FIG. 4. The voltage that is developed across sense resistor 11 is proportional to the amplitude of coil current ICOIL. The current ISENSE, from the current source comprising transistor 21 and resistor 17, is set mainly by the voltage on resistor 11. The current ISENSE is converted into voltage VSENSE by resistors 25 and 27 or equivalent circuitry shown in FIG. 2. The value of VSENSE is a function of the hammer coil current ICOIL. The control logic 85 turns transistor 15 "OFF" and "ON" so that VSENSE will chop between the high peak and low peak references until the print hammer is de-energized by one of the digital control inputs to control logic 85. The reference/compensation circuit output voltage VBUS controls the value of the high and low peak references for all of the hammer positions on the assembly.

The hammer control in the present invention allows the sense, reference and logic functions to be isolated from the noisy driver section. The predriver 87 is designed with current source type output drive. Its output current drive and power supply bias current (V2 bias) are not affected by the ground shift on PGND. The current source, made up of transistor 21 and resistor 17, is driven by resistor 11 which preferably has an impedance of less than one ohm. The current change in resistor 11, change in ISENSE, is limited by the L/R time constant of the hammer coil. Noise coupling into the ISENSE line, collector of transistor 21 to node VSENSE, will be discharged by the low impedance of node VSENSE, resistors 25 and 27, or the equivalent circuity of FIG. 2. The value of ISENSE and VSENSE constantly represents the value of current ICOIL in the hammer coil when using a "bottom drive" driver 15. Sense comparators 21 and 23 are designed with switching delays so that noise on node VSENSE is not detected and passed into the control logic.

The output of the logic control circuit is a high or low logic level. When the logic level is low, current source 93 turns on the switching device 15 to provide current to the coil. When the logic level is high the switching device 15 is turned off. Assuming the output of the control logic is high, then diode connected transistor 101 is reverse biased with transistor 105 providing current through transistor 103. Transistor 103 acts as a clamp keeping current source transistor 105 linear and is not active when transistor 101 is forward biased. Since the base voltage at transistor 107 provided through the voltage divider made up of resistors 113, 115, 117, 123 and diode connected transistor 121 is greater than the base voltage of transistor 109, which is developed by transistor 101 when the logic level is low, this transistor 107 of the differential pair of transistor 107 and 109 is biased into conduction. Transistor 125 and resistor 126 provide a current source for the differential transistor pair. With transistor 107 conducting, current flows through transistor 147 which turns on transistors 151 and 153 which are in parallel with one another. The voltage drop across resistor 155 and transistors 151 and 153 determine the base drive of transistor 161. The voltage drop across of resistor 155 is mainly a function of the current flowing in transistor 161. If transistor 161 is not fully turned on then the voltage drop across resistor 155 will be small and the voltage drop across the transistors 151 and 153 will increase, increasing the base drive. This loop control assures that transistor is turned on sufficiently to provide enough current to drive the switching device 15.

If the logic output from logic circuit 85 is high, transistor 101 is not conducting. The voltage at the base of transistor 109 of the differential transistor pair rises above the voltage at the base of transistor 107 of the differential transistor pair, causing transistor 109 to conduct. The voltage at base of transistor 107 is determined by the voltage divider of resistors 113, 115, 117, 123, and diode connected transistor 121, and does not vary significantly. The voltage at the base of transistor 109 rises since the current provided by transistor 105 creates a voltage drop across transistor 101 which is not conducting. With transistor 109 conducting, a current flows through transistor 127. Transistor 127, and transistors 131 and 135 form a current mirror with the current flowing in transistor 127 being matched in transistor 131 and also being matched in transistor 135. Thus, twice the current in transistor 127 is supplied to the impedance of the diode connected transistor 137 and resistor 143 to develop a base drive for transistor 141. Transistor 141 and resistor 145 provide a current sink for removing base current from transistor 15 to turn transistor off.

Since the on and off base drive for the coil driver transistors is supplied from switchable current sources in the predriver circuit, the amount of base drive flowing to transistors 15 is not affected by the change in voltage between the noisy power ground and "quiet" logic power supply V2 and logic ground. With no change in current, the logic supply voltage remains quiet.

In the present invention all circuit functions except for the drive/sense circuit are biased by a "quiet" low voltage power supply V2 which typically has a voltage of five volts. The functions are integrated circuit compatible and preferably can be placed on quiet voltage planes on circuit boards that are isolated from and not overlapped by voltage planes that carry the noisy coil bias power supply V1 and power ground. Circuit noise immunity is high and noise generation is low.

The present invention can be used with a negative coil biasing voltage. In this situation the switching device would be a pnp transistor or PFET arranged in a top drive configuration. The transistor in the current source would be an npn transistor. The sensing would be done near the negative voltage source. A logic level (using a negative voltage supply) predrive could be used to drive the switching device.

The foregoing has described a control circuit for accurately controlling large amounts of current (several amps) flowing in multiple coils that are located in an electrically noisy environment. The circuit reduces generated noise and has good noise immunity.

While the invention has been particularly shown and described with reference to a preferred embodiment thereof, it will be understood by those skilled in the art that various changes in form and detail may be made therein without departing from the spirit and scope of the invention.

I claim:

1. A circuit for monitoring the current flowing in a print hammer coil, comprising:

a first sense resistor in series with the print hammer coil; and current sense source in parallel with the first resistor, for providing a current proportional to the voltage across the first sense resistor and which does not flow through the coil wherein said current source comprises a second resistor and a transistor connected in series with one end of said second resistor, the base of said transistor being connected to an end of said first resistor nearest the print hammer coil, and the other end of said second resistor being connected to an other end of said first resistor.

2. A circuit for monitoring the current in a print hammer coil supplied from a first voltage source, said hammer coil being in series with a switch, said circuit comprising:

a first sense resistor in series with said print hammer coil;

a diode in parallel with the series combination of said first resistor and the coil, said diode being connected to carry current from said coil when the current supplied to the coil is interrupted; and current source means in parallel with said first resistor, for providing a current proportional to the voltage across said first resistor and which does not flow through the coil wherein said current source means comprises a second resistor and a transistor connected in series with one end of said second resistor, the base of said transistor being connected to an end of said first resistor nearest the print hammer coil, and the other end of said second resistor being connected to an other end of said first resistor.

* * * * *